United States Patent [19]

St-Jean et al.

[11] Patent Number: 4,736,080

[45] Date of Patent: Apr. 5, 1988

[54] PUFFER TYPE LIQUEFIED-GAS SELF-INJECTION CIRCUIT BREAKER

[75] Inventors: Guy St-Jean; Michel Landry; Robert Jeanjean; Daniel Demissy, all of Quebec, Canada

[73] Assignee: Hydro-Quebec, Quebec, Canada

[21] Appl. No.: 21,761

[22] Filed: Mar. 4, 1987

[30] Foreign Application Priority Data

Jul. 23, 1986 [CA] Canada ..... 514498

[51] Int. Cl.[4] ..... H01H 33/88

[52] U.S. Cl. ..... 200/148 A; 200/148 G; 200/150 G

[58] Field of Search ..... 200/150 G, 148 A, 148 G

[56] References Cited

U.S. PATENT DOCUMENTS

| | | | |
|---|---|---|---|
| 3,150,245 | 9/1964 | Leeds et al. | 200/148 G |
| 3,406,269 | 10/1968 | Fischer | 200/150 G |
| 3,839,613 | 10/1974 | Tsubaki et al. | 200/150 G |
| 4,273,978 | 6/1981 | Rostron | 200/150 G |
| 4,307,274 | 12/1981 | Rostron et al. | 200/150 G |
| 4,649,243 | 3/1987 | Thuries | 200/148 A |

*Primary Examiner*—Robert S. Macon

*Attorney, Agent, or Firm*—Oblon, Fisher, Spivak, McClelland & Maier

[57] ABSTRACT

A puffer type liquefied-gas self-injection circuit breaker, used for the interruption at low temperature of a high current carried by a high-voltage power line. The circuit breaker comprises a first fixed contact and a compression chamber. The compression chamber has a bottom part which is fixed and an upper part of which is movable in the axial direction with respect to the bottom part. The upper part of the compression chamber comprises a second contact and an envelope concentrically disposed thereabout. An insulating nozzle is formed in a top portion of the envelope. The internal wall of the envelope is so shaped as to exactly match the external profile of the bottom part of the compression chamber. The breaker is also equipped with a liquefied-gas self-injection system which injects the liquefied-gas from their storage tank via a feed line and valve directly onto the electric arc formed at the moment of current interruption. This system comprises an injection chamber located in the wall of the moving part of the compression chamber. The injection chamber is terminated at one end by a narrow injection channel acting as a nozzle directed towards the electric arc while the other end rests on a compression piston formed by a pre-injection chamber. The latter forms an integral part of the fixed bottom part of the compression chamber and is equipped at its top end with a check valve permitting its use as a compression piston when the valve is closed and permitting the transfer of liqufied-gas to the injection chamber when the valve is in the open position. A storage tank placed at the bottom of the compression chamber provides for the recuperation by gravity of all the liquefied-gas in the apparatus.

13 Claims, 4 Drawing Sheets

PUFFER TYPE LIQUEFIED-GAS SELF-INJECTION CIRCUIT BREAKER

BACKGROUND OF INVENTION

1. Field of Invention

In general, the present invention is directed to the interruption of a high current flowing on a high-voltage transmission line by means of a switching device known as a circuit breaker.

2. Description of Prior Art

More specifically, the object of the present invention is a puffer type liquefied-gas self-injection circuit breaker used to interrupt a high current on a high-voltage transmission line at ambient temperatures below the liquefaction temperature of the gas used.

In addition, the present invention provides for a puffer-type liquefied-gas self-injection circuit breaker comprising a device which permits the injection of liquefied gas directly on the electric arc formed at the moment of current interruption.

At the present time, there exist breaking devices of the type known as puffer circuit breakers in which the opening of the movable contact drives a compression chamber. The gases in the chamber are thereby compressed and expelled through an opening or nozzle to blast the electric arc produced between the contacts. This blasting operation produces the large mass flow rate required for extinction of the arc and interruption of the current. One advantage of this type of apparatus is that it is a "single-pressure" device and therefore does not need a high-pressure gas supply flowing into a lower-pressure chamber to supply the gas flow required for interruption, as "double-pressure" apparatus does. The breaking capacity of puffer-type breakers increases with their operating pressure and usually varies between 2 and 10 bar. However, the $SF_6$ gas habitually used in such apparatus liquefies at low temperatures. At −50° C., for example, the saturated vapor pressure is only 2.3 bar absolute whereas at −30° C. it is 4.9 bar. Therefore, when the temperature drops below the liquefaction temperature, part of the gas condenses and the vapor pressure of $SF_6$ decreases causing an almost proportional decrease in the breaking capacity. This limitation is fundamental to all these breakers, whose breaking capacity at −50° C. will be about 50% of that at −30° C. due to condensation.

SUMMARY OF INVENTION

The present invention avoids this reduction in breaking capacity by using a mechanism to inject the liquefied gas directly on the electric arc at the moment of arc interruption and compensate for the reduced performance. The injection principle consists in providing cavities in the walls of the compression chamber; the cavities are filled with liquefied gas and terminated at one end by a narroy injection channel directed toward the arc, whereas the other end rests on a compression piston. When the compression chamber is driven by the normal opening movement of the movable contact and moves in relation to a fixed injection piston, the liquefied gas contained in the cavities is injected onto the arc through the injection channel, thereby increasing the mass flow rate of the gas at the insulating nozzle. This design is mechanically very simple and can be adapted to any similar apparatus. Since the breaking capacity of the breaker is thus not affected by liquefaction, the operating pressure can be substantially higher, which in turn increases the breaking capacity.

BRIEF DESCRIPTION OF DRAWINGS

The present invention will be better understood with reference to FIGS. 1 to 7, in which.

DESCRIPTION OF PREFERRED EMBODIMENTS

To allow a better understanding of the invention, neither the leakproof casing used to house all the breaker components nor the contact opening mechanisms are shown.

Figure 1:
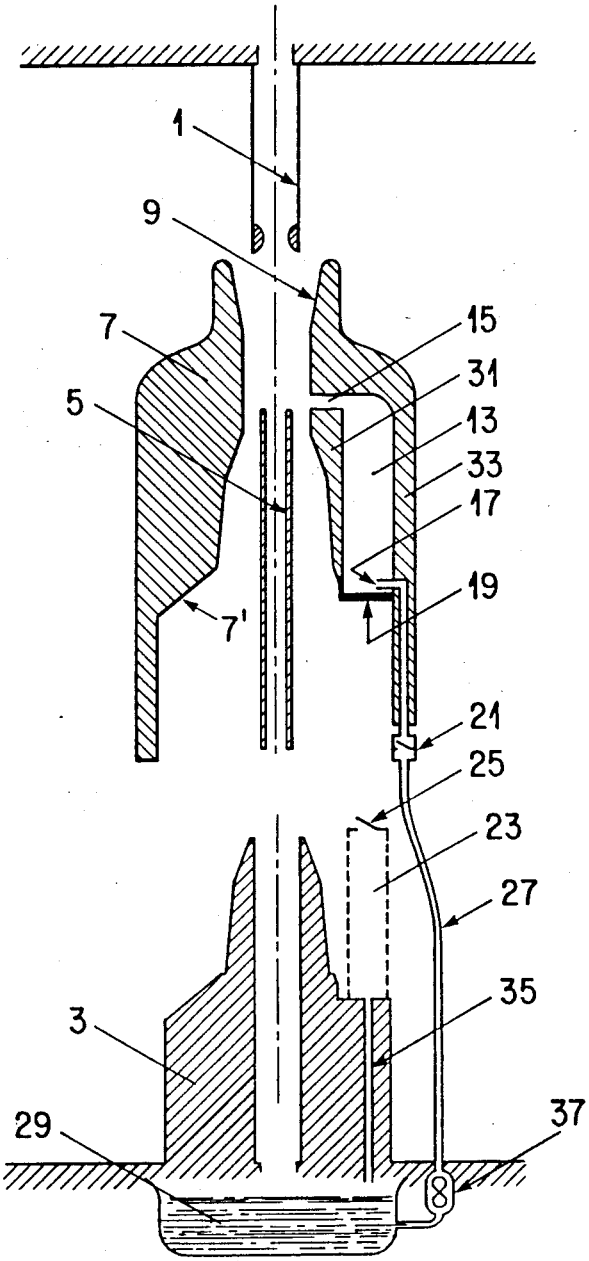
FIG. 1 is a cross-section view of a puffer-type liquefied-gas self-injection circuit breaker of the present invention.

The three main components are depicted in the form of a cross-section in FIG. 1 to simplify the description of the puffer-type liquefied-gas self-injection breaker. Illustrated here are the fixed contact 1 and the bottom part of the compression chamber 3, which is also fixed. The movable parts are all firmly attached together: the movable contact 5, the compression chamber 7, the insulating nozzle 9 and the liquefied-gas injection chamber with its injection channel 15, filling nozzle 17, sealing and transfer piston 19 and feed valve 21. FIG. 1 also shows the pre-injection chamber 23, together with its check valve, which forms the piston of the injection chamber, the liquid feed line 27 connected to a pumping system 37, the liquefied-gas storage tank 29 and the liquid leak return line 35.

The left side of FIG. 1 shows the shape 7' of the interior of an interruption chamber. The conventional profile of this chamber could be so designed to incorporate the liquid injection mechanism shown on the right, without significantly reducing the volume available for the gas in the compression chamber.

Figure 2:
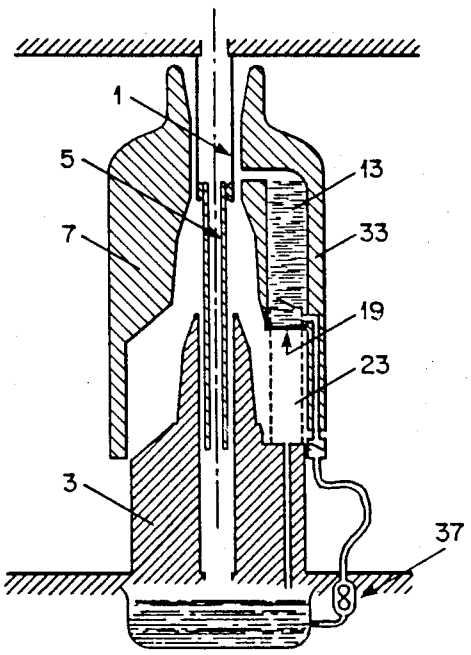
FIG. 2 is a cross-section view of the same breaker in the closed position allowing electric current to flow.

FIG. 2 shows the interruption chamber with contacts 1 and 5 closed when the injection chamber 13 is filled with liquefied gas available for injection. As can be seen, the said chamber is sealed by the upper part of the side wall of the pre-injection chamber 23 and the sealing piston 19.

Figure 3:
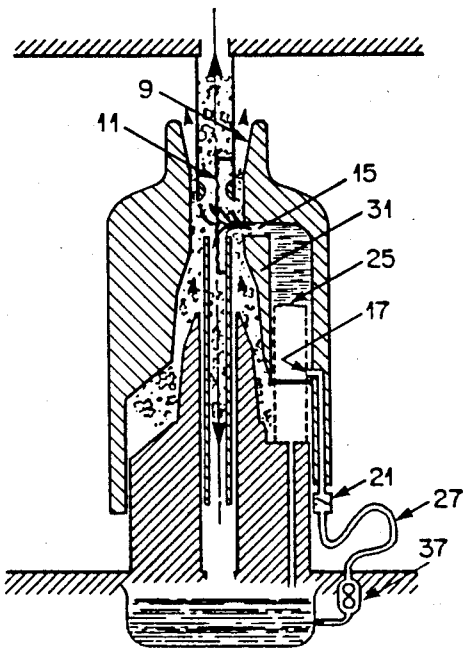
FIG. 3 is a cross-section view of the same breaker when the contacts separate, allowing current interruption.

FIG. 3 illustrates the flow of quenching gases around and along the electric arc 11 together with liquid injection on the arc when the contacts separate. It may be seen that the injection channel 15 is located below the nozzle 9 thus allowing the instantaneously volatilized liquid on the arc to join the gas flow through the nozzle. This significantly increases the amount of gas exhausted, thereby enhancing the breaking capacity. The instantaneous volatilization of the liquid in contact with the arc is due to the very high temperature reached by the arc (over 10,000° C.). The same figure shows that the check valve of the pre-injection chamber 25 is closed during this process and acts as a piston forcing the liquid towards the arc. This valve is thermically very far from the high temperatures of the arc and insulated therefrom by the axial gas flow, the small diameter of the injection channel 15 and the internal wall 31 of the compression chamber, which is usually made of Teflon TM.

Figure 4:
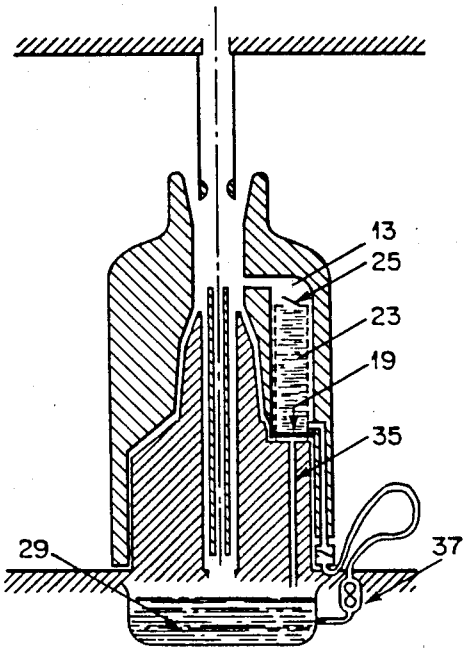
FIG. 4 is a cross-section view of the same breaker in the open position following current interruption.

FIG. 4 shows the interruption chamber in the open position in the presence of liquefied gas which is contained in the pre-injection chamber 23. The large check valve 25 allows the liquid to flow readily from the pre-injection chamber 23 to the injection chamber 13 when the contacts close. The closing speed of the contacts will therefore not be significantly reduced by the movement of the liquefied gas. To compensate for any liquid leads around the piston 19, the return of such liquid to the feed circuit is provided for line 35 towards the storage tank 29.

Figure 5:
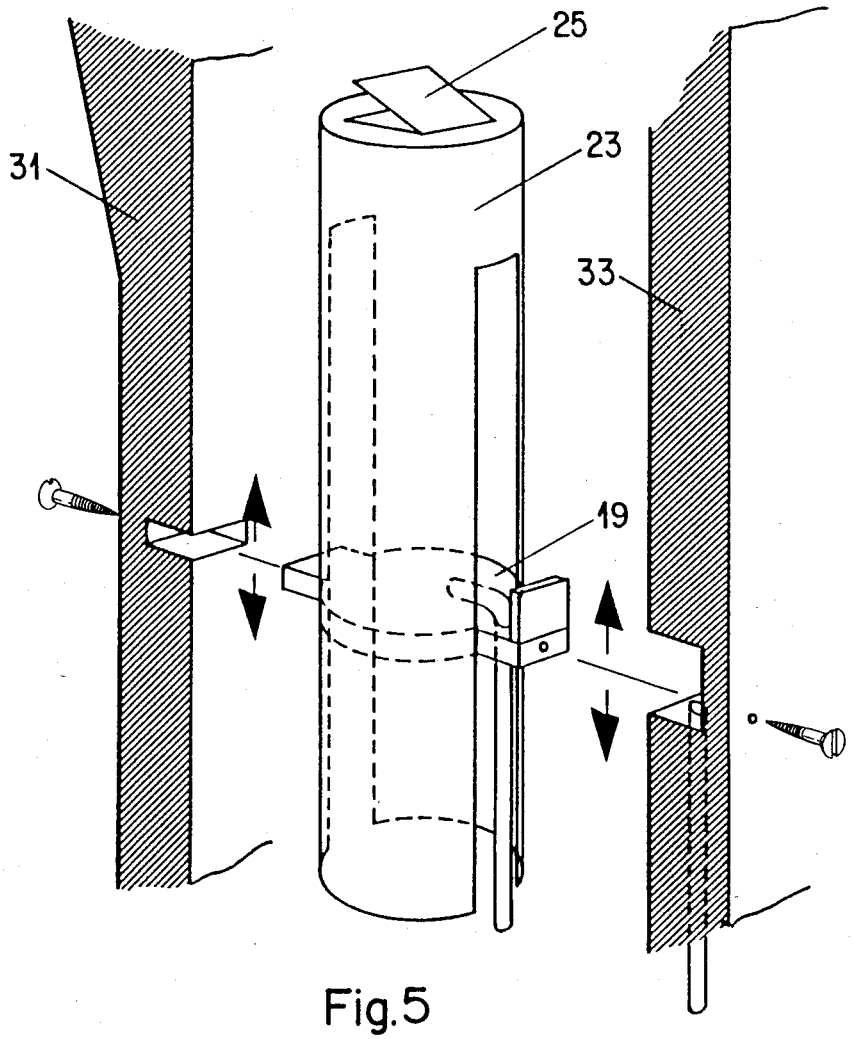
FIG. 5 is a perspective view of a pre-injection chamber.

FIG. 5 shows the construction principle of the pre-injection chamber 23 and its connection to the piston 19. The body of the chamber can be circular in section and consist of a cylinder made of metal or another material. The vertical wall of the cylinder contains diametrically opposed slots permitting the piston 19 to slide therein, said piston 19 being attached to walls 31 and 33 of the compression chamber.

Figure 6:
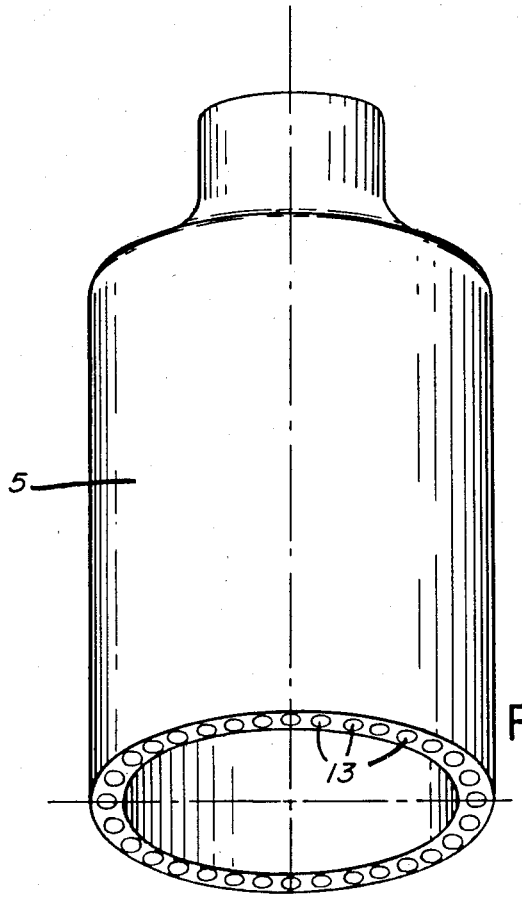
FIGS. 6 and 7 are perspective views showing injection chambers with circular and rectangular sections, respectively.
Figure 7:
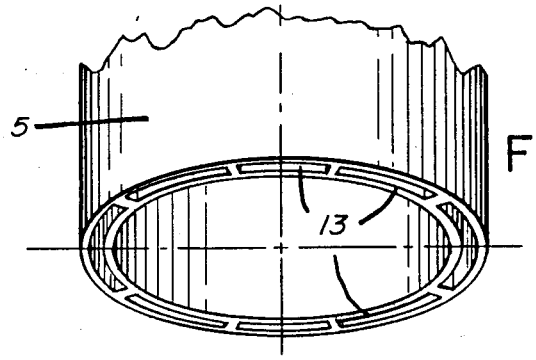

The shape of the section and the number of injection chambers and pre-injection chambers can differ in design. FIGS. 6 and 7 show configurations with circular and rectangular sections.

Since the design is not impaired by the presence of liquefied gas, the breaker of the present invention allows the use of higher gas pressures, thereby enhancing performance. In addition, the present conception can be adapted to any conventional puffer-type breaker with only minor modifications to the apparatus. It is very simple in construction and requires only one movable component, namely a simple check valve 25 located far enough away from the high temperature areas to assure a high level of reliability. Leaks in the liquid-injection system caused by an excessive number of operations are acceptable because a pumping system 37 is provided. However this pumping system would not need to be used much if the pressure was so chosen that liquefaction occurred at 0° C., −10° C. or −20° C. rather than at typical temperatures below −30° C.

It is within the ambit of the present invention to cover any obvious modifications of the preferred embodiment described herein, provided such modifications fall within the scope of the appended claims.

We claim:

1. A puffer-type liquefied-gas self-injection breaker for the interruption of a high current flowing in a high-voltage transmission line, said breaker comprising a first fixed contact and a compression chamber, said compression chamber having a bottom part which is fixed and an upper part which is movable in the axial direction with respect to said bottom part, said upper part having a second contact and an envelope around said second contact, said envelope having a top end constituting an insulating nozzle made of Teflon or any other equivalent material, said envelope having an internal wall profile to match an external wall profile of said fixed bottom part of said compression chamber, said envelope being provided with a means for injecting a liquefied-gas directly onto an electric arc produced during current interruption.

2. The breaker of claim 1 in which the liquefied-gas injection means is composed of at least one injection chamber filled with said liquefied-gas, said injection chamber comprising a narrow injection channel directed toward the electric arc and a compression piston for the injection.

3. The breaker of claim 2 in which the injection chamber consists of a cavity in the wall of said movable part of said compression chamber of the breaker, said narrow channel being located at the end opposed to said compression piston.

4. The breaker of claim 2 in which said injection chamber is constituted by an external mechanism independent of the compression chamber of the breaker.

5. The breaker of claim 2 in which the compression piston is constituted of a pre-injection chamber attached to said fixed part of said compression chamber.

6. The breaker of claim 2 in which a transfer piston is in contact through abutments with the internal and external walls of said movable part of said compression chamber and provides a seal between said injection chamber and said compression piston.

7. The breaker of claim 1 in which said second contact is concentric with said envelope.

8. The breaker of claim 3 in which said cavity has a circular section.

9. The breaker of claim 3 in which said cavity has a rectangular section.

10. The breaker of claim 5 in which said pre-injection chamber is composed of a hollow cylinder whose walls contain longitudinal slots allowing it to slide along the abutments of the transfer piston and whose top end is closed and is provided with a check valve which, in the closed position, allows said pre-injection chamber to be used as a compression piston and, in the open position, allows the transfer of the liquefied-gas from said pre-injection chamber to the injection chamber.

11. The breaker of claim 2 in which the injection chamber is equipped with a liquefied-gas filling nozzle to a feed valve, which in turn is connected to a pumping system allowing transfer of the liquefied gas contained in the storage tank provided for that purpose.

12. The breaker of claim 4 in which a liquid/leak/-return line is provided in said bottom part of said compression chamber, said return line connecting the bottom of a pre-injection chamber to a liquefied-gas storage tank.

13. The breaker of claim 1 in which the gas used is an electronegative gas such as sulfurhexafluoride ($SF_6$) or a gas mixture containing $SF_6$.

* * * * *

UNITED STATES PATENT AND TRADEMARK OFFICE

CERTIFICATE OF CORRECTION

PATENT NO. : 4,736,080

DATED : April 5, 1988

INVENTOR(S) : Guy St-Jean, Michel Landry, Robert Jean-Jean, Daniel Demissy

It is certified that error appears in the above-identified patent and that said Letters Patent is hereby corrected as shown below:

Column 3, second paragraph, line 15, first word "leads" should read --leaks--.

Signed and Sealed this

Fifth Day of June, 1990

*Attest:*

*Attesting Officer*

HARRY F. MANBECK, JR.

*Commissioner of Patents and Trademarks*